United States Patent [19]

Wang

[11] Patent Number: 4,907,771

[45] Date of Patent: Mar. 13, 1990

[54] HANGER WITH IMPROVED POSITIONING STRUCTURE

[76] Inventor: Wen-Mu Wang, 4-1F., No. 381, Sec. 5, Nangking East Rd., Taipei, Taiwan

[21] Appl. No.: 317,406

[22] Filed: Mar. 1, 1989

[51] Int. Cl.[4] ..... A47G 29/00

[52] U.S. Cl. ..... 248/222.1; 248/251

[58] Field of Search ..... 248/201, 251, 222.1, 248/224.3, 224.4; 16/110 R; 403/299, 306, 378

[56] References Cited

U.S. PATENT DOCUMENTS

| | | | |
|---|---|---|---|
| 1,773,815 | 8/1930 | Hoegger | 248/222.1 |
| 1,891,048 | 12/1932 | Keefe | 248/222.1 |
| 1,893,729 | 1/1933 | Call | 248/251 |
| 1,934,911 | 11/1933 | Campbell | 248/222.1 |
| 1,997,686 | 4/1935 | Hoegger | 248/222.1 |
| 2,158,734 | 5/1939 | Sladek | 248/251 |
| 2,176,644 | 10/1939 | Sladek | 248/222.1 |
| 2,512,209 | 6/1950 | Marchand | 248/222.1 |

*Primary Examiner*—Blair M. Johnson
*Assistant Examiner*—Robert A. Olson
*Attorney, Agent, or Firm*—Varndell Legal Group

[57] ABSTRACT

This invention relates to a hanger with improved positioning structure which can be fastened onto a wall by flat head screws. The flat head screws are concealed from view and are protected from breaking away from the wall. The hanger includes a brass mounting plate which is fastened onto wall surface separately from a brass cover plate by screws, which match with anchors in the wall. A spring is mounted on a mounting plate stem of the brass mounting plate. The brass cover plate is mounted on the mounting plate stem of the brass mounting plate so as to compress the spring cover the brass mounting plate, and conceal the flat head screws. A ceramic inset is set in a circular recess of the brass cover plate to make the structure more attractive. A connector connects with the mounting plate stem of the brass mounting plate by a pivot bolt so that the brass cover plate and the ceramic insert can be firmly retained between the brass mounting plate and the connector. A hanger device is coupled with the connector for hanging of towels or clothing or the like.

1 Claim, 3 Drawing Sheets

HANGER WITH IMPROVED POSITIONING STRUCTURE

BACKGROUND AND SUMMARY OF THE INVENTION

Following economic development, the standard of living has been improving each day. In consequence, when buying a product, the quality and practicability of the product are not the only factors to consider. For example, when buying sanitary facilities or accessories, in addition to good quality and high practicability, consumers may also require to have the features of attractive design, ease of installation convenience of operation, etc.

The present invention is related to a hanger with an improved positioning means and, more particularly, to a hanger for easy installation in, for example, a bathroom for hanging towels, clothing, etc.

A conventional hanger, as shown in FIG. 1, includes a holder plate fixedly connected with a ring-shaped hanger device or the like in an integral unit, having fixation holes for fixation of the whole assembly onto wall surface by means of screws passing through the fixation holes which are received by respective screw inserts within the wall. Because the hanger device is fixedly connected with the holder plate and not detachable therefrom, and because the hanging device is normally much bigger than the holder plate and arranged at the front of the holder plate, the hanging device may interfere with the installation of the conventional hanger. In other words, the hanging device may interfere with the tightening of the screws when installing the hanging device on the wall. Further, during the installation process, initially the screw insets or holes are normally made in the wall for fixation of the hanger by aligning the fixation holes at the screw inserts respectively, so that the screws can be accurately fixed therethrough. However, deviation or inaccuracy of the positioning of the screw inserts often occurs, which interferes with the fixation of the hanger, or the screws may be not completely threaded into the wall. Therefore, good quality of installation may be difficult to obtain. Sometimes, the protruding screw heads can easily be hooked on the towels or clothing during hanging thereof, which is bothersome.

The main object of the present invention is to provide a hanger with an improved positioning means, wherein concealed flat head screws and the hanger means are separately arranged to facilitate installation, and wherein a spring is arranged to help position the hanger device and to prevent the flat head screws from breaking away.

Further objects, features and advantages of the present invention will become more apparent from the following description in connection with the annexed drawings as hereunder.

DETAILED DESCRIPTION OF THE PREFERRED EMBODIMENTS

Figure 1:
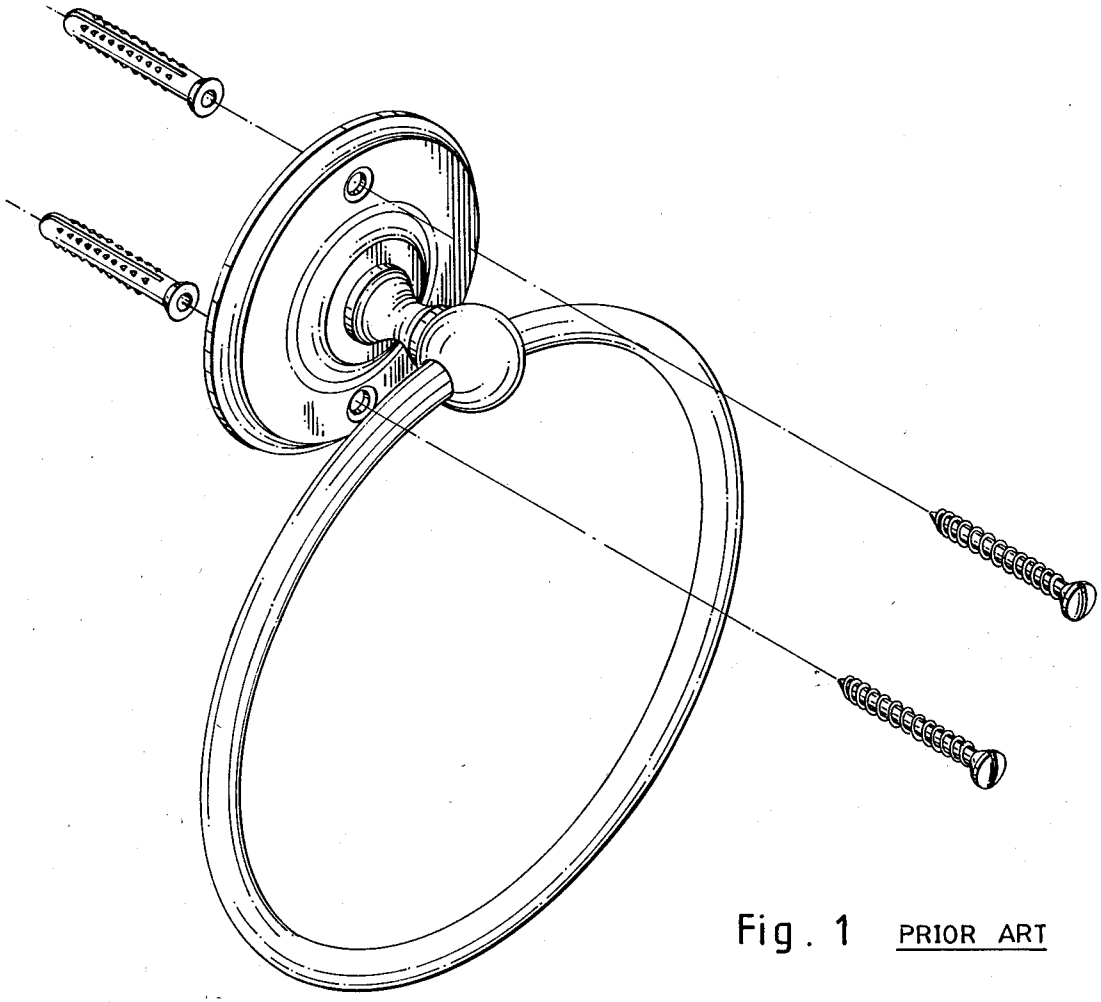
Fig. 1 PRIOR ART
FIG. 1 illustrates a structure of the prior art.
Figure 2:
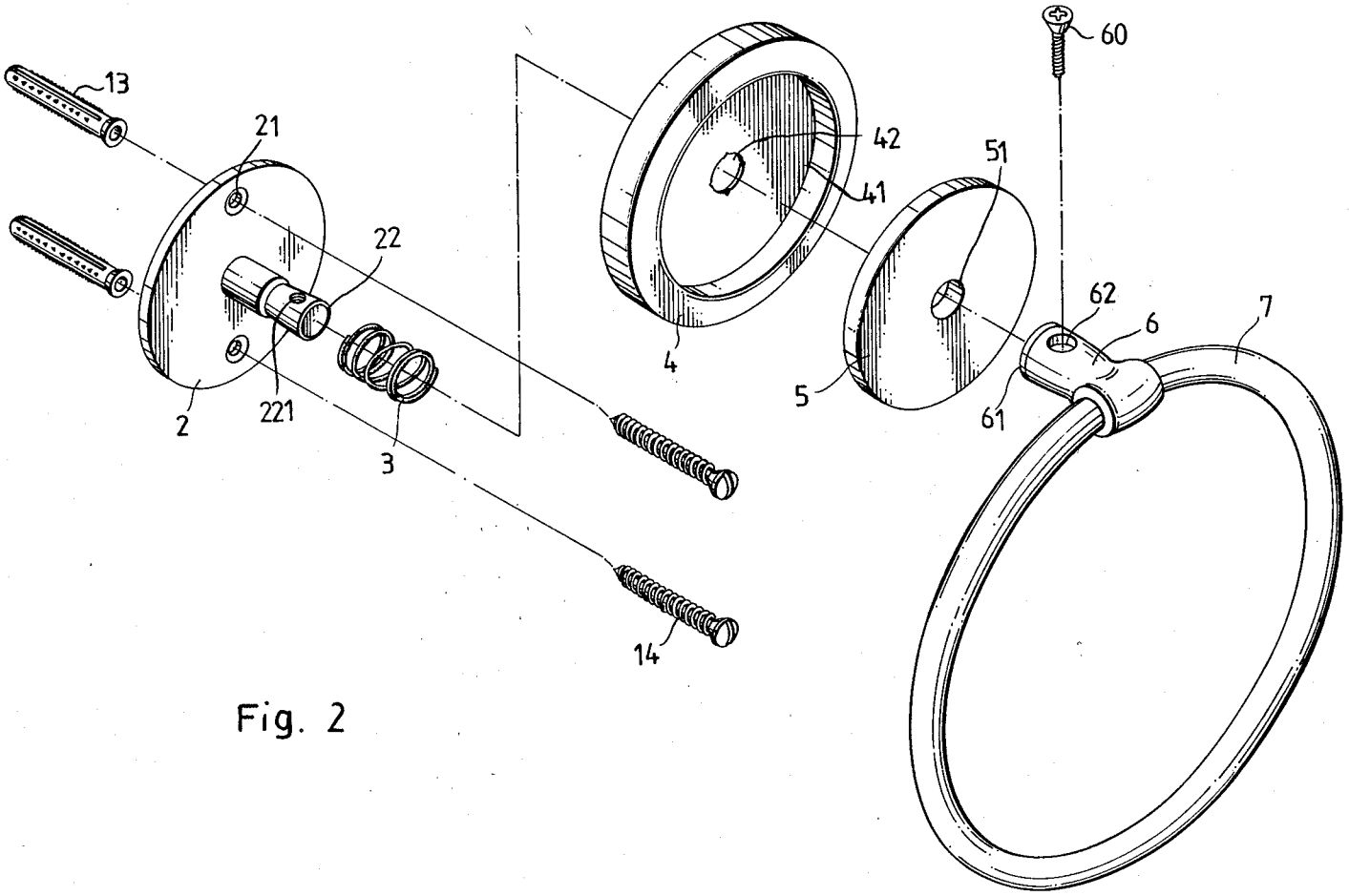
FIG. 2 is a perspective exploded view of a hanger embodying the present invention.

Referring to FIG. 2, the hanger of the present invention includes a brass mounting plate 2, a spring 3, a brass cover plate 4, a ceramic insert 5, a connector 6, and a hanging device 7. The brass mounting plate 2 is an independent flat disc having fixation holes 11 to respectively match with anchors 13 set inside wall surface for easy installation of the mounting plate onto the wall by means of respective screws or other flat head screws 14 before being connected with the hanging device 7. The brass mounting plate has a mounting plate stem 22 of unequal caliber arranged at its center for mounting thereon of the spring 3. A longitudinal hole 221 is provided in on the mounting plate stem 22.

Figure 3:
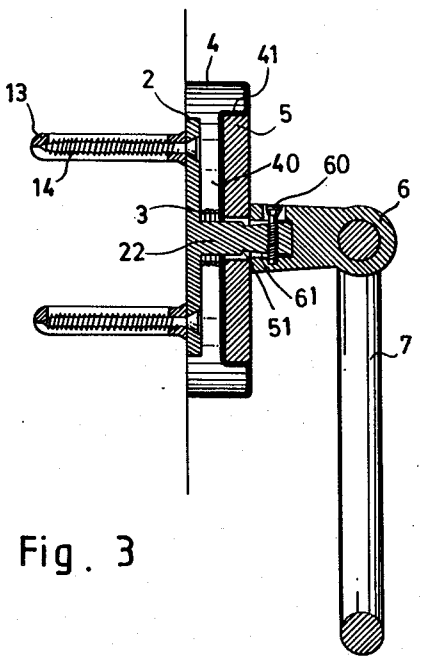
FIG. 3 is a sectional assembly view of the said preferred embodiment of FIG. 2.

The brass cover plate 4 has a circular recess 41 with a hole 42 made at center for the mounting plate stem 22 to be inserted therethrough in a manner which permits the cover plate 4 to cover the brass mounting plate 2 with the spring 3 retained therebetween after the brass mounting plate is firmly fixed onto the wall. This arrangement conceals the flat head screws from views, defines a flexible space 40 thereinside (as shown in FIG. 3, and prevents the flat head screws 14 from breaking away from the wall.

The ceramic insert 5 is arranged to match with the circular recess 41 of the brass cover plate 4, and has an axial hole 51 at its center for the mounting plate stem 22 to penetrate therethrough, when insert 5 is set in the circular recess of the brass cover plate 4. The ceramic insert 5 may be made of ceramic, metal or any other material and arrange in any color to match with the environment, so as to provide maximum decorative effect.

Figure 4:
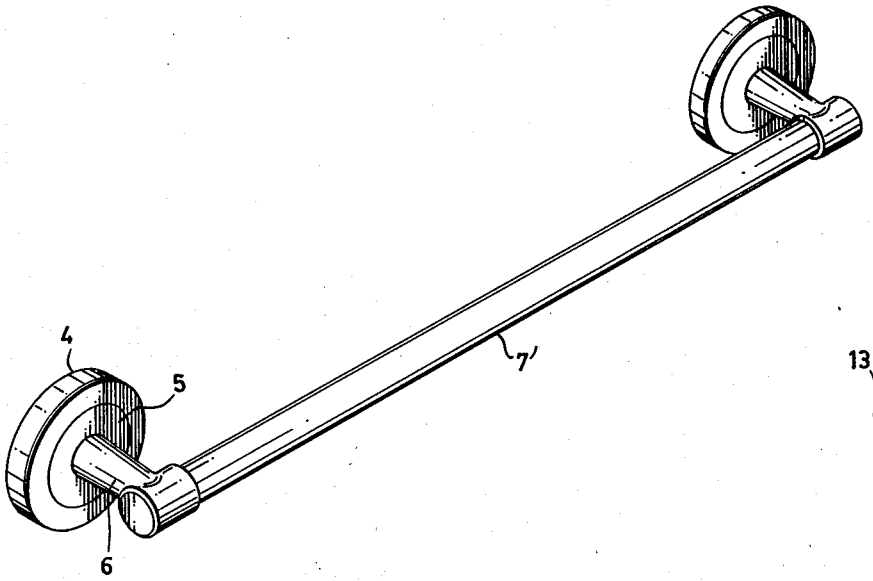
FIG. 4 illustrates a second embodiment constructed according to the present invention.

The connector 6 can have a ring-shaped hanging device 7 or an elongated hanging pipe 7' (as shown in FIG. 4) attached thereto. Connector 6 includes an axial hole for receiving the mounting plate stem 22, and a pivot hole 62 for fixation of the connector 6 with the mounting plate stem 22 of the brass mounting plate 2 by means of a Phillips head screw 60 passing through the pivot hole 62 and into the longitudinal hole 221. This arrangement permits the brass cover plate 4 and the ceramic insert 5 be firmly retained together and completes the assembly.

In general, as described above, the present invention provides a hanger in which the flat head screws are concealed from the outside and which assists in preventing their breaking away from the wall.

Another feature of the present invention is that the installation is more simple and the flat head screws can be accurately positioned.

I claim:

1. A flexible hanger having an improved installation, which comprises:

a brass mounting plate including a flat disc with a stem extending from its center and holes for fastening said mounting plate onto a wall surface by flat head screws, said mounting stem having an axle of unequal caliber and a longitudinal hole, a brass cover plate covering said mounting plate and having a circular recess for receiving a decorative ceramic plate, a spring positioned around said mounting stem between said mounting plate and said cover plate, said spring pressing against said mounting plate and said cover plate, and a connector holding said cover plate along said mounting stem, said connector having one end with a hanging device thereon and another end receiving said mounting stem and attached to said mounting stem by a pivot flat head screw passing through said longitudinal hole of said mounting stem, said pivot screw being arranged with said mounted stem so that action of said spring permits flexing between said connector, said mounting plate and said cover plate about said mounting stem for preventing said flat head screws from breaking away from said wall surface.

* * * * *